US009970085B2

(12) United States Patent
Takahashi et al.

(10) Patent No.: US 9,970,085 B2
(45) Date of Patent: May 15, 2018

(54) METHOD FOR PRODUCING PELLETS AND METHOD FOR PRODUCING IRON-NICKEL ALLOY

(71) Applicant: SUMITOMO METAL MINING CO., LTD., Tokyo (JP)

(72) Inventors: Junichi Takahashi, Tokyo (JP); Taku Inoue, Tokyo (JP); Shuuji Okada, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days. days.

(21) Appl. No.: 15/325,496

(22) PCT Filed: Jun. 30, 2015

(86) PCT No.: PCT/JP2015/068853

§ 371 (c)(1),
(2) Date: Jan. 11, 2017

(87) PCT Pub. No.: WO2016/013355

PCT Pub. Date: Jan. 28, 2016

(65) Prior Publication Data

US 2017/0152585 A1 Jun. 1, 2017

(30) Foreign Application Priority Data

Jul. 25, 2014 (JP) ..... 2014-151977

(51) Int. Cl.
*C22C 33/02* (2006.01)
*C22C 38/08* (2006.01)
(Continued)

(52) U.S. Cl.
CPC ..... *C22C 33/0235* (2013.01); *C21B 15/00* (2013.01); *C22B 1/2406* (2013.01); *C22C 38/08* (2013.01)

(58) Field of Classification Search
CPC ..... C22C 33/0235; C22C 38/08; C21B 15/00; C22B 1/2406
See application file for complete search history.

(56) References Cited

U.S. PATENT DOCUMENTS 3,319,949 A * 5/1967 Hanson ..... C22B 1/2406 266/160
3,388,870 A * 6/1968 Thumm ..... C22B 23/021 241/23

(Continued)

FOREIGN PATENT DOCUMENTS

AU 2014288374 B9 * 2/2017 ..... C22B 1/2406
CN 101717854 A * 6/2010

(Continued)

OTHER PUBLICATIONS

CN101717854A. Machine translation of the claims and description. (Year: 2010).*

(Continued)

*Primary Examiner* — George Wyszomierski
*Assistant Examiner* — Tima M McGuthry Banks
(74) *Attorney, Agent, or Firm* — Locke Lord LLP; James E. Armstrong, IV; Nicholas J. DiCeglie, Jr.

(57) ABSTRACT

Provided is a production method for producing pellets that are used for producing an iron-nickel alloy and that are produced by mixing at least a nickel oxide ore, a carbonaceous reducing agent, and an iron oxide and agglomerating the obtained mixtures, the method comprising: a step S11 for producing at least two types of mixtures having different mixing ratios of nickel oxide ore, carbonaceous reducing agent, and iron oxide; and a step S12 for forming pellets, which are agglomerates having a layered structure, by using the two or more types of mixtures such that the mixture with (Continued)

the highest content ratio of iron oxide, among the two or more types of mixtures forms the outermost layer.

5 Claims, 3 Drawing Sheets

(51) Int. Cl.
*C22B 1/24* (2006.01)
*C21B 15/00* (2006.01)

(56) References Cited

U.S. PATENT DOCUMENTS

| | | | | |
|---|---|---|---|---|
| 3,503,734 | A * | 3/1970 | Bell | C22B 23/005 423/152 |
| 3,746,533 | A * | 7/1973 | Moussoluos | C21B 13/006 420/95 |
| 3,849,113 | A | 11/1974 | Ban | |
| 4,042,375 | A | 8/1977 | Martin et al. | |
| 5,178,666 | A * | 1/1993 | Diaz | C22B 1/245 75/629 |
| 2005/0211020 | A1 | 9/2005 | Sugitatsu et al. | |

FOREIGN PATENT DOCUMENTS

| | | | | |
|---|---|---|---|---|
| CN | 101717854 | A | 6/2010 | |
| CN | 102094093 | A | 6/2011 | |
| CN | 102534194 | A | 7/2012 | |
| CN | 103451451 | A | 12/2013 | |
| GB | 1400505 | A | 7/1975 | |
| JP | 08-199249 | A | 8/1996 | |
| JP | 2004-156140 | A | 6/2004 | |
| WO | WO-2015005190 | A1 * | 1/2015 | C22B 1/2406 |

OTHER PUBLICATIONS

International Search Report dated Aug. 25, 2015, issued for PCT/JP2015/068853.
Extended European Search Report dated Jun. 27, 2017, issued to EP Patent Application No. 15824513.4.
Office Action dated Aug. 21, 2017, issued to CN Patent Application No. 201580035170.6.

* cited by examiner

METHOD FOR PRODUCING PELLETS AND METHOD FOR PRODUCING IRON-NICKEL ALLOY

TECHNICAL FIELD

The present invention relates to a method for producing pellets, and in more detail, relates to a method for producing pellets upon processing in a step of smelting nickel oxide ore, and a method for producing iron-nickel alloy using this.

BACKGROUND ART

As a method for smelting nickel oxide ore called limonite or saprolite, a method of dry smelting that produces nickel matt using a flash smelting furnace, a method of dry smelting that produces ferronickel using a rotary kiln or moving hearth furnace, a method of wet smelting that produces a mix sulfide using an autoclave, etc. have been known.

Upon loading the nickel oxide ore to the smelting step, pre-processing is performed for pelletizing, making into a slurry, etc. the raw material ore. More specifically, upon pelletizing the nickel oxide ore, i.e. producing pellets, it is common to mix components other than this nickel oxide ore, e.g., binder and reducing agent, then further perform moisture adjustment, etc., followed by loading into agglomerate producing equipment to make a lump on the order of 10 to 30 mm, for example (indicated as pellet, briquette, etc.; hereinafter referred to simply as "pellet").

Ferronickel is an alloy of iron (Fe) and nickel (Ni), and is mainly made a raw material of stainless steel; however, in stainless steel production, it is important to contain at least 2 wt % Ni as the composition of this ferronickel, and it is advantageous to have higher Ni content.

This is because, by using ferronickel having high Ni content upon producing stainless steel, it is possible to raise the Ni content in the stainless steel by a slight added amount. This is also because, in business dealing, the price is often small for the Fe part in ferronickel, and ferronickel smelting becomes a cost disadvantage when the Ni component is scarce.

For example, Patent Document 1 discloses technology of adjusting excess carbon content of the mixture in a mixing step to make a mixture by mixing raw materials including nickel oxide and iron oxide with carbonaceous reducing agent, as a pre-treatment method upon producing ferronickel using a moving hearth furnace.

Upon producing pellets in the aforementioned way, so as to satisfy the two conditions of (1) raising the Ni content as possible, and (2) the smelting reaction effectively progressing, it becomes possible to establish the Ni content in ferronickel to on the order of 4 wt % or higher, for example, by adjusting the components other than nickel oxide ore and pelletizing, and then producing ferronickel, which is an iron-nickel alloy, using these pellets. However, at the moment at which the smelting reaction completes, the size of the obtained ferronickel grains becomes small.

When the size of the ferronickel grains obtained in this way becomes small, the ferronickel is far smaller than the size of pellets with a diameter on the order of 10 mm to 30 mm, and split to on the order of several millimeters; therefore, there are problems in that handling upon recovering from the smelting furnace is difficult, and the recovery rate declines. In addition, since the slag obtained at the same time splits into grains with a diameter on the order of several millimeters, the handling is difficult.

In other words, along with the above-mentioned conditions of (1) and (2), although it is preferable to satisfy all conditions also including a condition (3) of suppressing the size of the obtained ferronickel grains becoming smaller, it has not been possible to satisfy condition (3) in particular with the conventional technology.

In addition, upon producing the pellets, by increasing the content of iron oxide to adjust Ni+Fe quality in the pellet to at least on the order of 35 wt % and then mixing, since it is obtained as one grain of ferronickel relative to one pellet, although the recovery is easy, the Ni content in ferronickel becomes on the order of 1.7 wt %, and thus will have fallen under 2 wt %. In other words, among the above-mentioned conditions (1) to (3), although the conditions (2) and (3) are satisfied, it has not been possible to satisfy condition (1)

Patent Document 1: Japanese Unexamined Patent Application, Publication No. 2004-156140

DISCLOSURE OF THE INVENTION

Problems to be Solved by the Invention

The present invention has been proposed taking account of such a situation, and has an object of providing a pellet production method that, upon pelletizing and smelting a nickel oxide ore to produce ferronickel, which is an iron-nickel alloy, makes the smelting reaction proceed effectively, increases the Ni content in the obtained ferronickel; and can suppress the ferronickel obtained after the smelting reaction from becoming small grains.

Means for Solving the Problems

The present inventors have thoroughly investigated in order to solve the aforementioned problem. As a result thereof, a method was found that generates at least two types of mixture having different content ratios of iron oxide from raw material powders, and using these at least two types of mixtures, forms pellets, which are lumps having a layered structure, so that the mixture having the largest content ratio of iron oxide forms the outermost layer. By reducing and heating using the pellets formed in this way, it was found that the smelting reaction progresses effectively, the Ni content in the ferronickel obtained rises, and it is possible to suppress splitting of the ferronickel obtained after the smelting reaction, thereby arriving at completion of the present invention. In other words, the present invention provides the following matters.

A first aspect of the present invention is method for producing pellets that are to be used for producing iron-nickel alloy, and are produced by mixing at least nickel oxide ore, carbonaceous reducing agent and iron oxide, and then agglomerating a mixture obtained, the method including: a mixing process step of forming at least two types of mixtures having different mixing ratios of the nickel oxide ore, the carbonaceous reducing agent and the iron oxide; and a pellet formation step of forming a pellet which is a lump having a layered structure using the at least two types of mixtures, so that a mixture having the largest content proportion of the iron oxide among the at least two types of mixtures obtained in the mixing process step forms an outermost layer.

According to a second aspect of the present invention, in the method for producing pellets as described in the first aspect, the mixing process step forms two types of mixtures, and the pellet formation step forms a pellet of two-layered structure using the two types of mixtures.

According to a third aspect of the present invention, in the method for producing pellets as described in the first or second aspect, a mixture having the smallest content proportion of the iron oxide among the mixtures generated in the mixing process step does not contain the iron oxide.

According to a fourth aspect of the present invention, in the method for producing pellets as described in any one of the first to third aspects, a mixture having the largest content proportion of the iron oxide among the mixtures generated in the mixing process step does not contain the nickel oxide ore and the carbonaceous reducing agent.

A fifth aspect of the present invention is a method for producing an iron-nickel alloy that produces an iron-nickel alloy from nickel oxide ore, the method including: a pellet production step of producing pellets from the nickel oxide ore; and a reducing step of heating the pellets obtained at a predetermined reducing temperature, in which the pellet production step includes: a mixing process step that generates at least two types of mixtures having different mixing ratios of the nickel oxide ore, the carbonaceous reducing agent and the iron oxide; and a pellet formation step of forming a pellet that is a lump having a layered structure using the at least two types of mixtures, so that a mixture having the largest content proportion of the iron oxide among the at least two types of mixtures obtained in the mixing process step forms an outermost layer.

Effects of the Invention

According to the present invention, upon producing ferronickel, which is an iron-nickel alloy, using pellets of nickel oxide ore, it is possible to make the smelting reaction proceed effectively, increase the Ni content in the obtained ferronickel, and suppress the ferronickel obtained after the smelting reaction from becoming small grains.

PREFERRED MODE FOR CARRYING OUT THE INVENTION

Hereinafter, a specific embodiment of the present invention (hereinafter referred to as "present embodiment") will be explained in detail while referencing the drawings. It should be noted that the present invention is not to be limited to the following embodiment, and that various modifications within a scope not departing from the gist of the present invention are possible.

<<1. Method for Smelting Nickel Oxide Ore>>

First, a method for smelting nickel oxide ore, which is raw material ore, will be explained. Hereinafter, it will be explained giving as an example a method of smelting (method for producing ferronickel) that produces ferronickel by pelletizing nickel oxide ore, which is the raw material ore, then generates metal (iron-nickel alloy (hereinafter the iron-nickel alloy is also referred to as "ferronickel") and slag by reduction treating these pellets, and then separates this metal and slag.

Figure 1:
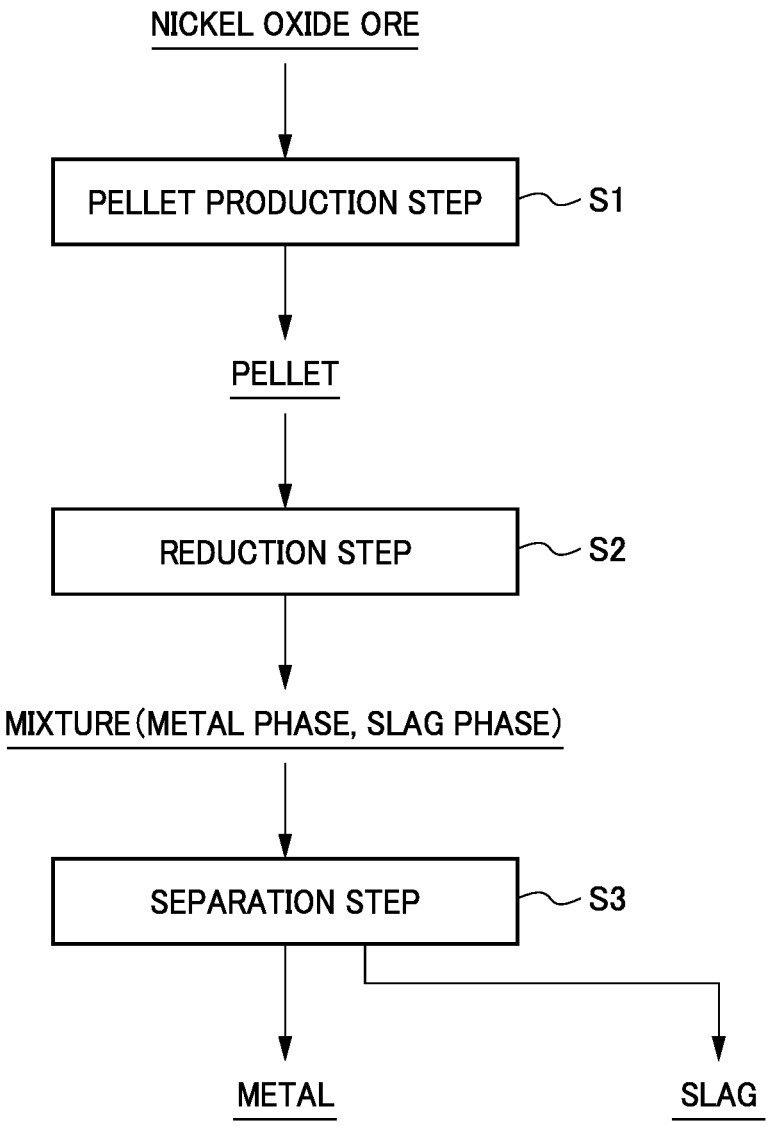
FIG. 1 is a process drawing showing the flow of a method for smelting nickel oxide ore.

The method for smelting nickel oxide ore according to the present embodiment is a method of smelting using pellets of nickel oxide ore, by loading these pellets into a smelting furnace (reducing furnace), then reducing and heating. More specifically, as shown in the process chart of FIG. 1, this method for smelting nickel oxide ore includes a pellet production step S1 of producing pellets from nickel oxide ore, a reduction step S2 of heating the obtained pellets in a reducing furnace at a predetermined reduction temperature, and a separation step S3 of recovering metal by separating the slag and metal generated in the reduction step S2.

<1.1. Pellet Production Step>

Figure 2:
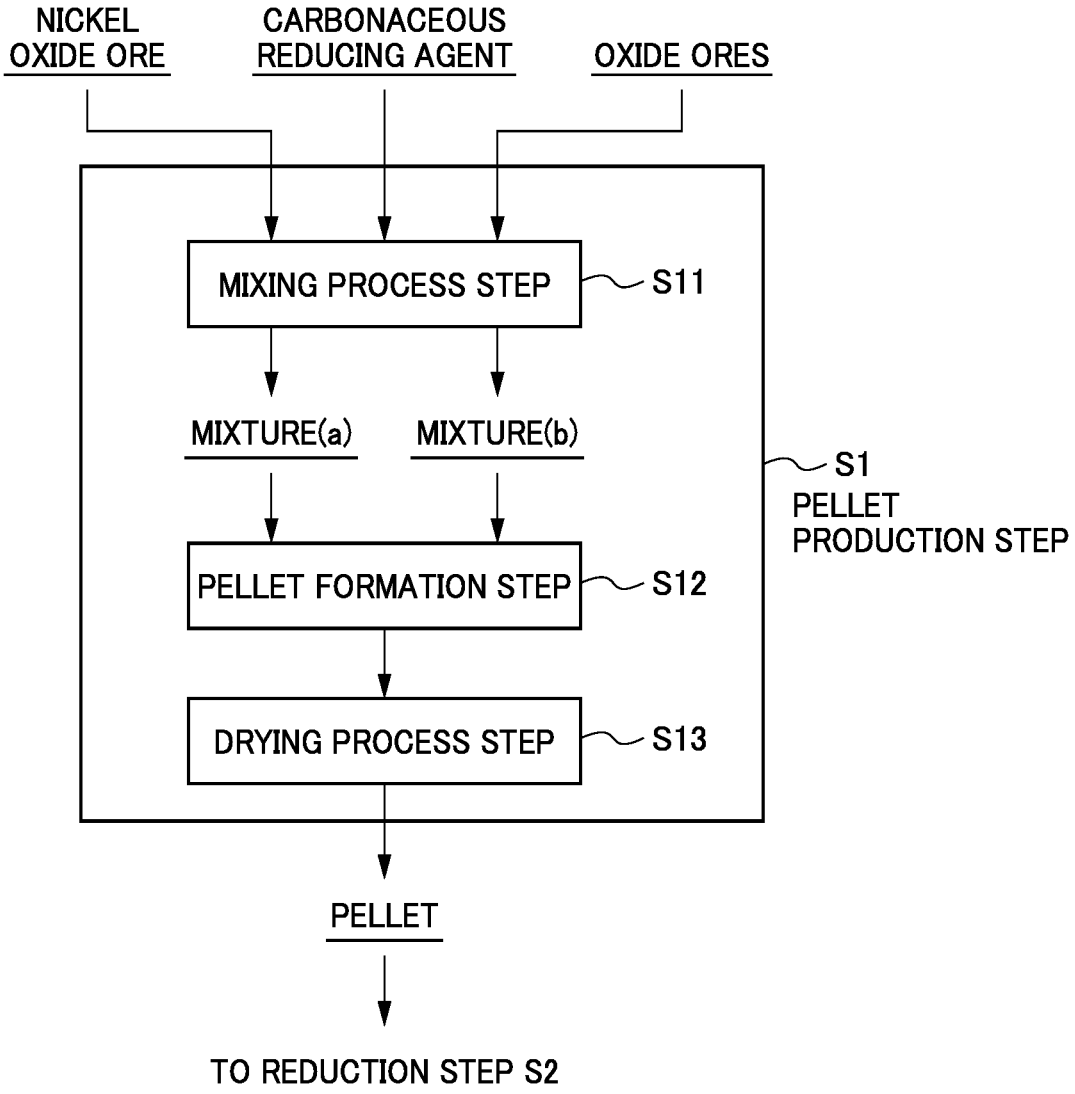
FIG. 2 is a process flow chart showing the flow of processing in a pellet production step of the method for smelting nickel oxide ore.

The pellet production step S1 produces pellets from nickel oxide ore, which is the raw material ore. FIG. 2 is a process flow chart showing the flow of processing in the pellet production step S1. As shown in FIG. 2, the pellet production step S1 includes a mixing process step S11 of mixing the raw materials including the nickel oxide ore, a pellet formation step S12 of forming (granulating) pellets, which are lumps, using the obtained mixture, and a drying process step S13 of drying the obtained pellets.

(1) Mixing Process Step

The mixing process step S11 is a step of obtaining a mixture by mixing the raw material powders including nickel oxide ore. More specifically, this mixing process step S11 obtains a mixture by at least mixing nickel oxide ore that is the raw material ore, carbonaceous reducing agent, and iron oxide. It should be noted that it is additionally possible to add and mix flux component, binder, etc. as necessary. Although the particle size of these raw materials is not particularly limited, the mixture is obtained by mixing raw material powders with a particle size on the order of 0.2 mm to 0.8 mm, for example.

The nickel oxide ore is not particularly limited; however, it is possible to use limonite ore, saprolite ore, etc.

In addition, powdered coal, pulverized coke, etc. are given as the carbonaceous reducing agent, for example. This carbonaceous reducing agent is preferably equivalent in particle size to the aforementioned nickel oxide ore.

In addition, as the iron oxide, it is possible to use iron having an iron quality on the order of at least 50%, for example, hematite obtained by wet smelting of nickel oxide ore, etc.

Otherwise, it is possible to give bentonite, polysaccharides, resins, water glass, dewatered cake, etc. as the binder, for example. In addition, it is possible to give calcium oxide, calcium hydroxide, calcium carbonate, silicon dioxide, etc. as the flux component, for example.

An example of the composition of a part of the raw material powder (wt %) is shown in Table 1 noted below. It should be noted that the composition of the raw material powder is not limited thereto.

TABLE 1

| Raw material powder [Wt %] | Ni | $Fe_2O_3$ | C |
|---|---|---|---|
| Nickel oxide ore | 1~2 | 50~60 | — |
| Iron ore | — | 80~95 | — |
| Carbonaceous reducing agent | — | — | ≈55 |

Herein, although described later in detail, the present embodiment generates at least two types of mixtures having different mixing ratios of nickel oxide ore, carbonaceous reducing agent and iron oxide in this mixing process step S11. It is characterized in generating a plurality of mixtures with different content proportions of iron oxide by generating a plurality of mixtures having different mixing ratios of raw material powders in this way. Then, using the obtained at least two types of mixtures, pellets are formed having a layered structure with different content proportions of iron oxide in the subsequent pellet formation step S12.

It should be noted that, although the flowchart shown in FIG. 2 is illustrated giving as an example the case of generating two types of mixtures (mixture (a), mixture (b)) having different mixing ratios of nickel oxide ore, carbonaceous reducing agent and iron oxide in this mixing process step S11, the number of mixtures is not limited to two types.

(2) Pellet Formation Step

The pellet formation step S12 is a step of forming (granulating) the mixture of raw material powders obtained in the mixing process step S11 into pellets, which are lumps. More specifically, it forms pellets by adding the moisture required in agglomerating to the mixture obtained in the mixing process step S11, and using a lump production device (such as a rolling granulator, compression molding machine, extrusion machine), etc., or by the hands of a person.

The pellet shape is not particularly limited; however, it can be established as spherical, for example. In addition, although the size of the lump made into pellet shape is not particularly limited, passing through the drying process and preheat treatment described later, for example, it is configured so as to become on the order of 10 mm to 30 mm in size (diameter in case of spherical pellet) of pellet to be loaded into the smelting furnace, etc.

In the present embodiment, the aforementioned mixing process step S11 generates at least two types of mixtures having different mixing ratios of raw material powders (e.g., generates mixture (a) and mixture (b) shown in the flowchart of FIG. 2), and the pellet formation step S12 forms pellets having a layered structure with different content proportions of iron oxide using these at least two types of mixtures obtained. More specifically, it is characterized in that the pellet formation step S12 forms pellets using these at least two types of mixture, so that the mixture having a large content proportion of iron oxide constitutes the outermost layer.

By forming pellets of layered structure having a layer with large content proportion of iron oxide as the outermost layer, and smelting by conducting reducing heat treatment in a subsequent step using this (reduction step S2) in this way, it is possible to raise the Ni content in the ferronickel that is the metal component obtained by causing the smelting reaction to effectively progress, and it is possible to suppress this ferronickel from splitting into small grains. It should be noted that details are described later.

(3) Drying Process Step

The drying process step S13 is a step of drying the pellets that are lumps obtained in the pellet formation step S12. The pellets (lumps) formed become a sticky state in which moisture is included in excess at about 50 wt %, for example. Therefore, in order to facilitate handling of this pellet, the drying process step S13 is configured to conduct the drying process so that the solid content of the pellet becomes on the order of 70 wt % and the moisture becomes on the order of 30 wt %, for example.

More specifically, the drying processing on the pellet in the drying process step S13 is not particularly limited; however, it blows hot air at 300° C. to 400° C. onto the pellet to make dry, for example. It should be noted that the temperature of the pellet during this drying process is less than 100° C.

An example of the solid content composition (parts by weight) of the pellet after the drying process is shown in Table 2 noted below. It should be noted that the composition of the pellet after the drying process is not limited thereto.

TABLE 2

| composition of pellet solid component after drying [Parts by weight] | | | | | | | |
|---|---|---|---|---|---|---|---|
| Ni | $Fe_2O_3$ | $SiO_2$ | CaO | $Al_2O_3$ | MgO | Binder | Other |
| 0.5~1.5 | 30~60 | 8~30 | 4~10 | 1~8 | 2~9 | 1 measure | remainder |

The pellet production step S1 granulates (agglomerates) the mixture of raw material powders including nickel oxide ore, which is the raw material ore, as mentioned above, and dries this, thereby producing pellets. The size of the obtained pellet is on the order of 10 mm to 30 mm, and pellets having strength that can maintain shape, e.g., strength for which the proportion of pellets breaking is no more than about 1% even in a case causing to drop from a height of 1 m, are produced. Such pellets are able to endure shocks such as dropping upon loading into the subsequent process of the reduction step S2, and can maintain the shape of the pellets, and appropriate gaps are formed between pellets; therefore, the smelting reaction in the smelting step will progress suitably.

It should be noted that, in this pellet production step S1, it may be configured so as to provide a preheat treatment step of preheat treating at a predetermined temperature the pellets, which are lumps on which the drying process was conducted in the aforementioned drying process step S13. By conducting preheat treatment on the lumps after the drying process to produce pellets in this way, it is possible to more effectively suppress heat shock-induced cracking (breaking, crumbling) of pellets, also upon reducing and heating the pellets at high temperatures on the order of 1400° C., for example, in the reduction step S2. For example, it is possible to make the proportion of pellets breaking among all pellets loaded into the smelting furnace to be a slight proportion at less than 5%, and thus possible to maintain the shape for at least 95% of pellets.

More specifically, the pellets subjected to the drying process are preheat treated at a temperature of 350° C. to 600° C. in the preheat treatment. In addition, it is preferable to preheat treat at a temperature of 400° C. to 550° C. By preheat treating in this way at a temperature of 350° C. to 600° C., preferably 400° C. to 550° C., it is possible to decrease the crystallization water contained in the nickel oxide ore constituting the pellets, and even in the case of suddenly raising the temperature by loading into a smelting furnace at about 1400° C., it is possible to suppress breaking of pellets due to desorption of this crystallization water. In addition, by conducting such preheat treatment, the thermal expansion of particles such as the nickel oxide ore, carbonaceous reducing agent, iron oxide, binder and flux component constituting the pellets becomes two stages, and will progress slowly, whereby it is possible to suppress breaking of pellets caused by the expansion difference between particles. It should be noted that the processing time of the preheat treatment is not particularly limited, and may be adjusted as appropriate according to the size of the lump containing nickel oxide ore; however, if a lump of a normal size for which the size of pellet obtained is on the order of 10 mm to 30 mm, it can be set as a processing time on the order of 10 minutes to 60 minutes.

<1.2. Reduction Step>

The reduction step S2 heats the pellets obtained in the pellet production step S1 at a predetermined reduction temperature. By way of the reducing heat treatment of the pellets in this reduction process S2, the smelting reaction progresses, whereby metal and slag are formed.

More specifically, the reducing heat treatment of the reduction step S2 is performed using a smelting furnace (reducing furnace), and reduces and heats the pellets containing nickel oxide ore by loading into the smelting furnace heated to a temperature on the order of 1400° C., for example. In the reducing heat treatment of this reduction step S2, the nickel oxide and iron oxide in the pellet near the surface of the pellet which tends to undergo the reduction reaction first is reduced to make an iron-nickel alloy (ferronickel) in a short time of about 1 minute, for example, and forms a husk (shell). On the other hand, the slag component in the pellet gradually melts accompanying the formation of the shell, whereby liquid-phase slag forms in the shell. In one pellet, the ferronickel metal (hereinafter referred to simply as "metal") and the ferronickel slag (hereinafter referred to simply as "slag") thereby form separately.

Then, by extending the processing time of the reducing heat treatment of the reduction step S2 up to on the order of 10 minutes further, the carbon component of the surplus carbonaceous reducing agent not contributing to the reduction reaction contained in the pellet is incorporated into the iron-nickel alloy and lowers the melting point. As a result thereof, the iron-nickel alloy melts to become liquid phase.

As mentioned above, although the slag in the pellet melts to become liquid phase, it becomes a mixture coexisting as the separate phases of the metal solid phase and slag solid phase by subsequent cooling, without the blending together of the metal and slag that have already formed separately. The volume of this mixture shrinks to a volume on the order of 50% to 60% when comparing with the loaded pellets.

In the case of the aforementioned smelting reaction progressing the most ideally, it will be obtained as one mixture made with the one metal solid phase and one slag solid phase coexisting relative to one loaded pellet, and becomes a solid in a "potbellied" shape. Herein, "potbellied" is a shape in which the metal solid phase and slag solid phase join. In the case of being a mixture having such a "potbellied" shape, since this mixture will be the largest as a particle size, the time and labor in recovery will lessen and it is possible to suppress a decline in metal recovery rate upon recovering from the smelting furnace.

It should be noted that the aforementioned surplus carbonaceous reducing agent is not only mixed into the pellets in the pellet production step S1 and, for example, it may be prepared by spreading over the coke, etc. on the hearth of the smelting furnace used in this reduction step S2.

The method for smelting nickel oxide ore according to the present embodiment, in the pellet production step S1 as mentioned above, is configured so as to generate at least two types of mixtures having different mixing ratios of nickel oxide ore, carbonaceous reducing agent and iron oxide, and using these at least two different types of mixtures, produce pellets, which are lumps, having a layered structure such that the mixture having the largest content proportion of iron oxide becomes the outermost layer. Therefore, by loading such pellets into the smelting furnace to reduce and heat, it is possible to cause the smelting reaction to progress effectively, and it is possible to raise the Ni content in ferronickel, which is the metal component obtained. In addition, it is possible to suppress this ferronickel from splitting into small grains, and it is possible to obtain ferronickel of a size for which handling is easy.

<1.3. Separation Step>

The separation step S3 recovers metal by separating the metal and slag generated in the reduction step S2. More specifically, a metal phase is separated and recovered from a mixture containing the metal phase (metal solid phase) and slag phase (slag solid phase containing carbonaceous reducing agent) obtained by the reducing heat treatment on the pellet.

As a method of separating the metal phase and slag phase from the mixture of the metal phase and slag phase obtained as solids, for example, it is possible to use a method of separating according to specific gravity, separating according to magnetism, cracking by a crusher, etc., in addition to a removal method of unwanted substances by sieving. In addition, it is possible to easily separate the obtained metal phase and slag phase due to having poor wettability, and relative to the aforementioned "potbellied" mixture, for example, it is possible to easily separate the metal phase and slag phase from this "potbellied" mixture by imparting shock such as providing a predetermined drop and allowing to fall, or imparting a predetermined vibration upon sieving.

The metal phase (ferronickel) is recovered by separating the metal phase and slag phase in this way.

<<2. Formation of Pellets in Pellet Production Step>>

Next, the pellet production step S1 in the method for smelting nickel oxide ore will be explained in further detail. In the aforementioned way, the pellet production step S1 includes a mixing process step S11 of mixing the raw materials including nickel oxide ore, a pellet formation step S12 of forming pellets, which are lumps, using the obtained mixture, and a drying process step S13 of drying the obtained pellets.

Then, the present embodiment is characterized in that, upon producing pellets by at least mixing nickel oxide ore, carbonaceous reducing agent and iron oxide, and agglomerating the obtained mixture, at least two types of mixtures differing in the mixing ratios of iron oxide with nickel oxide ore and carbonaceous reducing agent are formed, and pellets are formed which are lumps having a layered structure using these at least two types of mixtures so that the mixture having the largest content proportion of iron oxide (iron oxide ratio) among the obtained at least two types of mixtures becomes the outermost layer.

Figure 3:
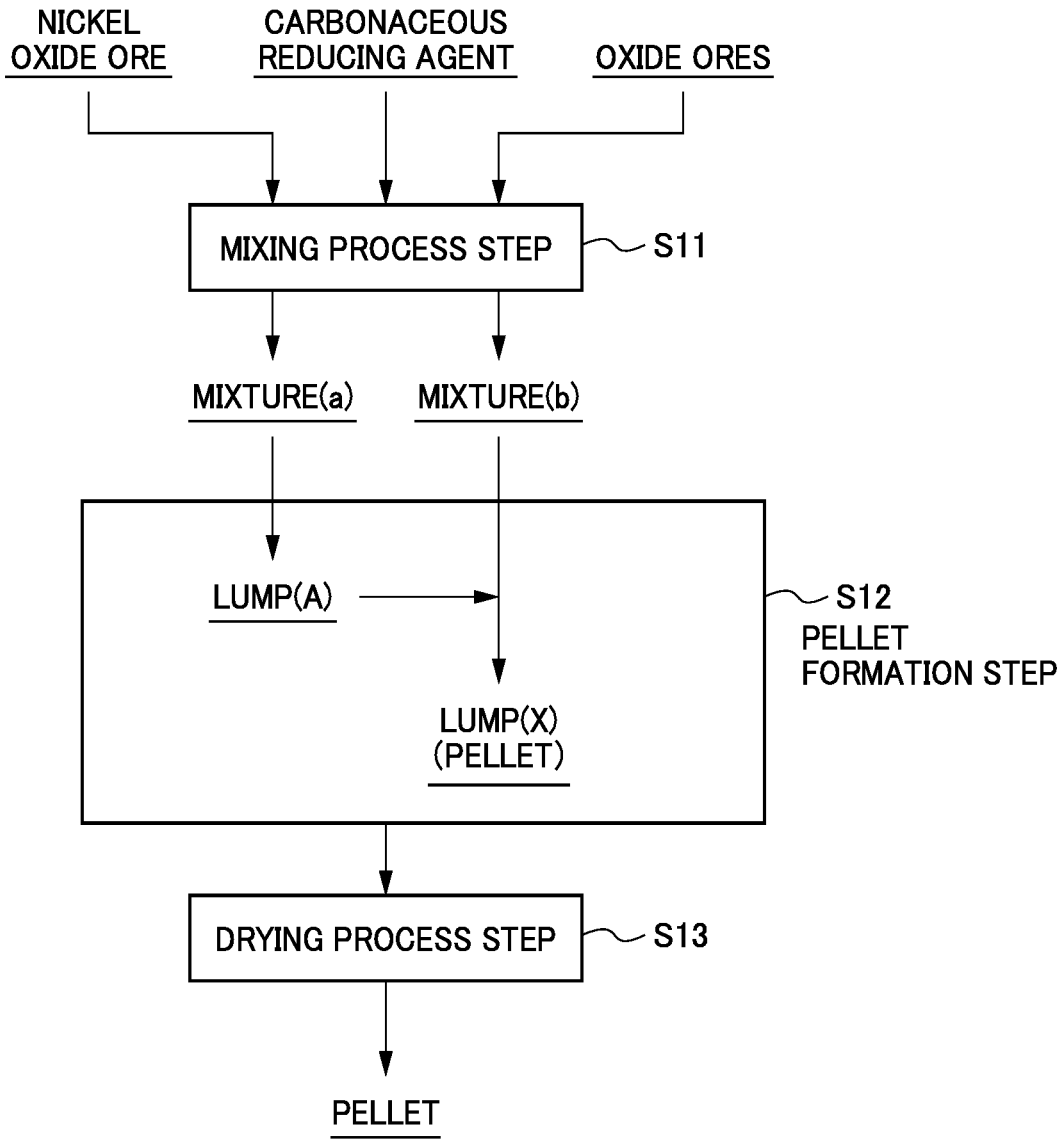
FIG. 3 is a process flow chart showing the flow of processing in a pellet production step of the method for smelting nickel oxide ore.

More specifically, as in the flow chart showing an example in FIG. 3, first, two types of mixtures differing in the content ratios of iron oxide are formed (mixture (a), mixture (b)), by changing the mixing ratio of iron oxide with nickel oxide ore and carbonaceous reducing agent, which are raw material powders, in the mixing processing step S11. It should be noted herein that the relationship of iron oxide content ratios is mixture (a)<mixture (b). Next, in the pellet formation step S12, water, etc. is added to mixture (a) having the smaller iron oxide ratio among the obtained two types of mixtures to make a spherical lump (lump (A)), for example, followed by adhering mixture (b) with a large iron oxide ratio to this spherical lump (A) so as to cover the outside (circumference) thereof. A lump (X) (pellet) is thereby formed consisting of a layered structure having an inner layer consisting of the mixture (a) with relatively low iron oxide ratio and an outer layer (outermost layer) consisting of the mixture (b) with a relatively large iron oxide ratio. It should be noted that the pellet used in the reduction step S2 is made by drying the obtained pellet of two-layered structure.

In this way, it becomes important to generate at least two types of mixtures differing in iron oxide content proportions by generating mixtures with different mixing ratios of raw material powders, and to make pellets having a layered structure with different content proportions of iron oxide, so that the mixture with the largest mixing proportion of iron oxide constitutes the outermost layer using the these at least two types of mixing. By conducting reducing heat treatment and smelting using the pellets of layered structure having a layer with the larger mixing proportion of iron oxide as the outermost layer formed in this way, it is possible cause the smelting reaction to progress effectively, and raise the Ni content percentage in ferronickel, which is the obtained metal component, and possible to suppress this ferronickel from splitting into small grains.

Herein, as the iron oxide, for example, it is possible to use iron ore having an Fe quality on the order of at least 50%, hematite obtained from dry smelting of nickel oxide ore, etc.

In addition, as the pellet of layered structure, so long as the outermost layer thereof is a layer with a large mixing proportion of iron oxide, the mixing ratio of iron oxide may not necessarily increase in a sequential layer state as moving from the inner layer (inside) to outer layer (surface) of the pellet.

For example, as an example of the pellet configuration, it is possible to make a pellet of two-layered structure establishing the inner layer (first layer) of the pellet as a layer of the lump consisting of a mixture of nickel oxide ore and carbonaceous reducing agent, and establishing the outer layer (second layer, outermost layer) of the pellet as a layer consisting of only iron oxide. In addition, it may configure a pellet of three-layered structure establishing the inner layer (first layer) of the pellet as a layer of the lump consisting of a mixture of nickel oxide ore (containing $Fe_2O_3$) and carbonaceous reducing agent, establishing an intermediate layer (second layer) of the pellet as a layer consisting of only the carbonaceous reducing agent (not containing iron oxide), and establishing the outer layer (third layer, outermost layer) of the pellet as a layer consisting of only iron oxide. It should be noted that, in the case of a pellet of the aforementioned three-layered structure, the third layer that is the outermost layer is a layer consisting of only iron oxide, and becomes the layer with the largest mixing proportion of iron oxide.

With the pellet formed in this way, since the outermost side thereof (outermost layer) is formed by a mixture with large iron oxide ratio, a metal shell is efficiently formed at the outermost side of this pellet, in the first stage of a reduction step that reduces and heats. Herein, the Ni quality of the metal shell formed is less than 2 wt %, e.g., on the order of 1.7%. It should be noted that the Fe quality required in order for the metal shell to more efficiently form is preferably at least 35 wt %, and more preferably at least 40 wt %.

Then, as the temperature rise advances and the smelting reaction progresses, it becomes a strongly reducing atmosphere by the carbonaceous reducing agent inside of this metal shell, solid metal forms, and slag forms based on the remaining components excluding the components forming the metal. The metal obtained herein is at least 2 wt % Ni quality, e.g., on the order of 3.7%.

Furthermore, when the temperature rise advances and reaches on the order of 1400° C., the slag formed inside of the metal shell melts, and the metal also melts from the carburizing from the carbonaceous reducing agent.

Then, finally, this carburizing extends to the metal shell, the metal shell melts, and becomes integral with the melted metal inside. In other words, the metal and slag come to separate into two phases. The Ni quality of the metal obtained herein becomes at least 2 wt %.

As above, the present embodiment makes a pellet of layered structure having a layer with larger mixing proportion of iron oxide in the outermost layer, and smelts by conducting reducing heat treatment using this. By producing ferronickel, which is an iron-nickel alloy, using the pellet obtained in this way, (1) it is possible to set the Ni content in the obtained ferronickel to at least 2 wt %, (2) cause the smelting reaction to progress effectively, and (3) possible to suppress the ferronickel obtained after the smelting reaction from splitting into small grains.

Herein, in the mixing process step S11 forming the mixtures by mixing raw material powders, it is preferable to form two types of mixtures as the number of mixtures with different mixing ratios of iron oxide with nickel oxide ore and carbonaceous reducing agent. In other words, it is possible to obtained the aforementioned effects (1) to (3) from the simplest configuration using the two types of mixtures with different content proportions of iron oxide, by making the layer on the outer side of the pellet to be a composition with the largest mixing proportion of iron oxide that can form the metal shell, and making a two-layer pellet with the inner side layer as a layer containing at least nickel oxide ore and carbonaceous reducing agent.

As the mixture with the smallest iron oxide ratio obtained in the mixing process step S11, it is preferable to be a mixture not containing iron oxide. The layer on the inner side of the pellet is a layer containing at least nickel oxide ore and carbonaceous reducing agent; therefore, the mixture forming this layer on the inner side of the pellet is preferably a mixture not containing iron oxide, which is the simplest configuration.

In addition, the mixture with the largest iron oxide ratio obtained in the mixing process step S11 preferably is a mixture not containing nickel oxide ore and carbonaceous reducing agent. In the present embodiment, it becomes important to establish the layer on the outer side of the pellet as a composition that can form the metal shell effectively from the smelting reaction, and the mixture forming the layer on the outer side of the pellet is preferably a mixture not containing nickel oxide ore and carbonaceous reducing agent so as to make the simplest configuration.

EXAMPLES

Hereinafter, the present invention will be explained more specifically by showing Examples and Comparative Examples; however, the present invention is not to be limited to the following Examples.

Example 1

A mixture (a) was obtained by mixing nickel oxide ore as the raw material ore, silica sand and limestone as flux, and coal as carbonaceous reducing agent. The component composition of the nickel oxide ore and carbonaceous reducing agent is shown in Table 3 noted below.

TABLE 3

| Raw material powder [Wt %] | Ni | $Fe_2O_3$ | C |
|---|---|---|---|
| Nickel oxide ore | 1~2 | 50~60 | — |
| Carbonaceous reducing agent | — | — | ≈55 |

Next, iron ore water of a firm slurry form consisting of the component composition shown in Table 4 noted below was prepared to make a mixture (b).

TABLE 4

| Raw material [Wt %] | Ni | $Fe_2O_3$ | C |
|---|---|---|---|
| Iron ore | — | 80~95 | — |

Next, a spherical lump with a size on the order of 13 mm to 17 mm was formed by kneading by hand while adding water to the obtained mixture (a). Then, the slurry form mixture (b) was adhered to the formed spherical lump so as to cover the outer side (circumference) of this lump, to make a lump (pellet) on the order of 17 mm to 25 mm.

The formed pellet was preliminarily heated by holding for 2 hours at a temperature of 105° C., and further dried by holding for 2 hours at 170° C. Subsequently, crystallization water was removed by holding for 30 minutes in a furnace at 400° C. to calcine (preliminary heating) the dried pellet.

Reduction treatment was performed by spreading the carbonaceous reducing agent on the inside of an alumina crucible, placing thereon the pellet immediately after calcining (state retaining calcination temperature), and loading the crucible inside the furnace at a reducing temperature of 1400° C.

As a result of performing the reduction treatment, the proportion of broken pellets was 0%, and was a state in which the slag solid phase and metal solid phase both adhered in a potbellied shape, and the smelting reaction effectively progressed. Then, as a result of separating only the metal (ferronickel) phase and recovering, the Ni quality in the obtained metal was 2.1%, and the ferronickel of high Ni content was obtained, without the ferronickel splitting into small grains.

In this way, in Example 1, it was possible to cause the smelting reaction to progress effectively, possible to establish the Ni content in the obtained ferronickel as a high proportion of at least 2 wt %, and possible to suppress the ferronickel obtained after the smelting reaction from splitting into small grains.

Comparative Example 1

After obtaining the mixture (a) by mixing nickel oxide ore as the raw material ore, silica sand and limestone as flux, and coal as the carbonaceous reducing agent, a spherical lump (pellet) on the order of 13 mm to 17 mm was formed by kneading by hand while adding water. Then, this pellet was preliminarily heated by holding for 2 hours at a temperature of 105° C., and further dried by holding for 2 hours at 170° C. Subsequently, crystallization water was removed by holding for 30 minutes in a furnace at 400° C. to calcine (preliminary heating) the dried pellet.

Reduction treatment was performed by spreading the carbonaceous reducing agent on the inside of an alumina crucible, placing thereon the pellet immediately after calcining (state retaining calcination temperature), and loading the crucible inside the furnace at a reducing temperature of 1400° C.

As a result of performing the reduction process, the proportion of broken pellets was 0%. However, the obtained metal (ferronickel grains) split into very fine small grain form of 1 to 3 mm diameter. It should be noted that the Ni quality in the obtained metal was 3.7 wt %.

In this way, in Comparative Example 1, although it was possible to cause the smelting reaction to progress, and possible to make the Ni content in the obtained ferronickel to be a high proportion of at least 2 wt %, the ferronickel obtained after the smelting reaction split into small grains, and handling was very difficult.

The invention claimed is:

1. A method for producing pellets that are to be used for producing iron-nickel alloy, and are produced by mixing nickel oxide ore, a carbonaceous reducing agent and iron oxide, and then agglomerating a mixture obtained, the method comprising:

a mixing process step of mixing at least one selected from the nickel oxide ore, the carbonaceous reducing agent and the iron oxide and forming at least two types of mixtures, wherein the at least two types of mixtures have different mixing ratios of the nickel oxide ore, the carbonaceous reducing agent and the iron oxide and the at least one of the at least two types of mixtures comprises the nickel oxide ore; and a pellet formation step of forming a pellet which is a lump having a layered structure using the at least two types of mixtures, so that a mixture having the largest content proportion of the iron oxide among the at least two types of mixtures obtained in the mixing process step forms an outermost layer.

2. The method for producing pellets according to claim 1, wherein the mixing process step forms two types of mixtures, and wherein the pellet formation step forms a pellet of two-layer structure using the two types of mixtures.

3. The method for producing pellets according to claim 1, wherein a mixture having the smallest content proportion of the iron oxide among the mixtures generated in the mixing process step does not contain the iron oxide.

4. The method for producing pellets according to claim 1, wherein a mixture having the largest content proportion of the iron oxide among the mixtures generated in the mixing process step does not contain the nickel oxide ore and the carbonaceous reducing agent.

5. A method for producing an iron-nickel alloy that produces an iron-nickel alloy from nickel oxide ore, the method comprising:

a pellet production step of producing pellets from the nickel oxide ore; and a reducing step of heating the pellets obtained at a predetermined reducing temperature, wherein the pellet production step includes:

a mixing process step of mixing at least one selected from the nickel oxide ore, a carbonaceous reducing agent and iron oxide and forming at least two types of mixtures, wherein the at least two types of mixtures have different mixing ratios of the nickel oxide ore, the carbonaceous reducing agent and the iron oxide; and at least one of the at least two types of mixtures comprises the nickel oxide ore; and a pellet formation step of forming a pellet that is a lump having a layered structure using the at least two types of mixtures, so that a mixture having the largest content proportion of the iron oxide among the at least two types of mixtures obtained in the mixing process step forms an outermost layer.

* * * * *